US007320281B2

(12) United States Patent
Becker et al.

(10) Patent No.: US 7,320,281 B2
(45) Date of Patent: Jan. 22, 2008

(54) METHOD OF VARYING A DRUM PROFILE OF A VARIO DRUM AND VARIO DRUM FOR IMPLEMENTING THE METHOD

(75) Inventors: Willi Becker, Bammental (DE); Daniel Conzelmann, Dielheim (DE); Karl-Heinz Helmstädter, Heidelberg (DE); Thorsten Eckart, Ilvesheim (DE); Christian Görbing, Heidelberg (DE); Hans-Peter Hiltwein, Waghäusel (DE); Olaf Lorenz, Ludwigshafen (DE); Stefan Mutschall, Östringen (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 390 days.

(21) Appl. No.: 10/744,737

(22) Filed: Dec. 22, 2003

(65) Prior Publication Data

US 2004/0135312 A1 Jul. 15, 2004

(30) Foreign Application Priority Data

Dec. 20, 2002 (DE) ..... 102 59 939

(51) Int. Cl.
*B41F 1/30* (2006.01)
*B41F 21/10* (2006.01)
*B41F 22/00* (2006.01)

(52) U.S. Cl. ..... 101/409; 101/246; 101/407.1; 101/410; 101/415.1; 101/232; 271/277

(58) Field of Classification Search ..... 101/232, 101/407.1, 409, 415.1, 410, 246; 271/277
See application file for complete search history.

(56) References Cited

U.S. PATENT DOCUMENTS

| | | | | |
|---|---|---|---|---|
| 1,358,843 | A * | 11/1920 | Grass | 101/142 |
| 4,608,925 | A * | 9/1986 | Arlt | 101/411 |
| 5,701,819 | A * | 12/1997 | Stephan | 101/409 |
| 5,862,755 | A * | 1/1999 | Haupenthal | 101/246 |
| 5,901,955 | A * | 5/1999 | Klopfenstein | 271/277 |
| 6,082,260 | A | 7/2000 | Friedrichs et al. | |

FOREIGN PATENT DOCUMENTS

DE 34 47 596 C2 7/1986

(Continued)

OTHER PUBLICATIONS

Werner Krause: "Konstruktionselemente der Feinmechanik" [structural elements of precision mechanics], Carl Hanser Verlag, München, 1989, pp. 523, 524.

*Primary Examiner*—Daniel J. Colilla
*Assistant Examiner*—Marissa Ferguson-Samreth
(74) *Attorney, Agent, or Firm*—Laurence A. Greenberg; Werner H. Stemer; Ralph E. Locher

(57) ABSTRACT

A method of varying a drum profile of a vario drum for transporting printing material sheets, in which shell segments of the vario drum are pivoted inward and outward. Sheet supporting elements assigned to the shell segments are reversibly deformed by pivoting the shell segments. A vario drum suitable for implementing the method and a machine containing the vario drum for processing printing material sheets contain the shell segments and the associated sheet supporting elements.

11 Claims, 8 Drawing Sheets

FOREIGN PATENT DOCUMENTS

| | | | |
|---|---|---|---|
| DE | 44 42 301 | C2 | 3/1996 |
| DE | 196 44 011 | A1 | 5/1998 |
| DE | 199 12 706 | C2 | 10/2000 |
| EP | 0 734 858 | B1 | 10/1996 |
| EP | 1 010 526 | A1 | 6/2000 |

* cited by examiner

METHOD OF VARYING A DRUM PROFILE OF A VARIO DRUM AND VARIO DRUM FOR IMPLEMENTING THE METHOD

BACKGROUND OF THE INVENTION

Field of the Invention

The present invention relates to a method of varying a drum profile of a vario drum for transporting printing material sheets in which the vario drum has shell segments that are alternatively pivoted inward and outward. Moreover the invention relates to a vario drum for transporting printing material sheets and has a drum profile and shell segments which are mounted such that they can alternatively be pivoted inward and outward in order to vary the profile.

In order to be able to transport alternatively both flexible paper sheets and stable board sheets without smearing using one and the same sheet transport drum, various vario drums have already been proposed in the past, for example see German Patents DE 44 42 301 C2, corresponding to U.S. Pat. No. 5,701,819, and DE 199 12 709 C2. The drum profile of such a vario drum can alternatively be set to be circular for the transport of the paper sheets and to be narrow, for example oval or substantially triangular, for the transport of the board sheets.

In this connection, there are two requirements that the vario drum should meet which cannot be readily combined with each other. First, the shell segments should be capable of being pivoted inward as far as possible, in order to rule out any collision between the shell segments and the area of the board sheets close to the trailing edge. Second, the shell segments should be as long as possible in order that they can carry the paper sheets over their entire sheet length. Meeting both requirements is a constructional problem, for a better understanding of which reference is made at this point to FIGS. 15 to 17 and their description in Published, European Patent EP 1 010 526 A1.

In order to solve this problem, the last-named patent application proposed in each case using two shorter shell segments instead of one longer shell segment.

However, a new problem arises from this problem solution. The two shorter shell segments form a separable joint at their mutually facing, free segment ends when they are pivoted outward (see Published, European Patent EP 1 010 526 A1, therein FIG. 2). On the basis of given production tolerances, wear which occurs and other factors, in this case the segment end of one shell segment can project a little beyond that of the other in the radial direction and, so to speak, form a projecting impact edge in the center of the sheet supporting surface for the paper sheet. There is the risk that this paper sheet or the printed image on its underside will be scratched by the aforesaid impact edge and, accordingly, the paper sheet will become waste.

Published, Non-Prosecuted German Patent Application DE 196 44 011 A1, corresponding to U.S. Pat. No. 6,082,260, discloses a reversibly deformable sheet supporting element in the form of a resilient film or of a cloth (see DE 196 44 011 A1, therein FIG. 6, item 61), and European Patent EP 0 734 858 B1 discloses a reversibly deformable sheet supporting element in the form of a shell film. However, these solutions are not able to make any effective contribution to solving the problem relating to the impact edge.

SUMMARY OF THE INVENTION

It is accordingly an object of the invention to provide a method of varying a drum profile of a vario drum and a vario drum for implementing the method which overcome the above-mentioned disadvantages of the prior art methods and devices of this general type, by which either the production of an impact edge in the center of the sheet supporting surface is avoided or at least the negative effects of such an impact edge on the printing material sheet is minimized to an acceptable level, and of providing a vario drum suitable for implementing the method.

The method according to the invention of varying a drum profile of a vario drum for transporting printing material sheets, in which shell segments of the vario drum are alternatively pivoted inward and outward, is distinguished by the fact that sheet supporting elements assigned to the shell segments are reversibly deformed by pivoting the shell segments.

The vario drum according to the invention for transporting printing material sheets, having a drum profile and shell segments mounted such that they can alternatively be pivoted inward and outward in order to vary the profile, is suitable for implementing the method according to the invention and is distinguished by the fact that sheet supporting elements are assigned to the shell segments and are constructed and disposed in such a way that they are reversibly deformable by pivoting the shell segments.

The invention permits compliant lengthening of the shell segments by the sheet supporting elements, specifically without restricting the pivoting angle of the shell segments.

In the event that the shell segments form separable joints together with other shell segments, covering of the separable joints by the sheet supporting elements is provided, so that the separable joints or their impact edges which may possibly be present can no longer damage the printing material sheets resting on the sheet supporting elements. This is because the sheet supporting elements are located between the separable joints and the printing material sheets, so that the latter are protected against being scratched by the impact edges.

Otherwise, the aforesaid separable joints may also be avoided completely by using the sheet supporting elements, by the sheet supporting elements being connected to the shell segments with the formation of smooth joints and thus permanently. As opposed to the separable joints, which open when the shell segments are pivoted inward and close again when the shell segments are pivoted outward, the smooth joints are joints whose joint width depends on the production-induced jointing accuracy and not on the pivoting positions assumed by the shell segments. The sheet supporting elements and the shell segments can be remachined in the region of the smooth joints when already joined together, so that the impact edges that may possibly be present are leveled. For example, the sheet supporting elements and the shell segments can be ground jointly in the region of their smooth joints, so that the projecting impact edges are removed and leveled as a result.

In addition, the smooth joints can be sealed, for example with a suitable filler material before being ground, so that ideal, interruption-free sheet supporting surfaces are created.

The method according to the invention and the vario drum according to the invention are intended for a machine processing the printing material sheets, for example a bookbinding further processing machine. However, they are primarily intended for a sheet-fed press, by which the printing material sheets are printed with a printing ink or a varnish.

In accordance with an added feature of the invention, the sheet supporting elements are flexurally elastic and similar to leaf springs.

In accordance with an additional feature of the invention, the sheet supporting elements are concave at a specific point when the shell segments are pivoted inward, and are convex at the specific point when the shell segments are pivoted outward.

In accordance with another feature of the invention, the sheet supporting elements are flexible and similar to cylinder covers.

In accordance with a further feature of the invention, springs are provided for tensioning the sheet supporting elements.

In accordance with a further added feature of the invention, the sheet supporting elements are disposed to cover the shell segments on an outside.

In accordance with a concomitant feature of the invention, the sheet supporting elements have self-supporting deformation sections by which the drum profile is determined.

Other features which are considered as characteristic for the invention are set forth in the appended claims.

Although the invention is illustrated and described herein as embodied in a method of varying a drum profile of a vario drum and a vario drum for implementing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
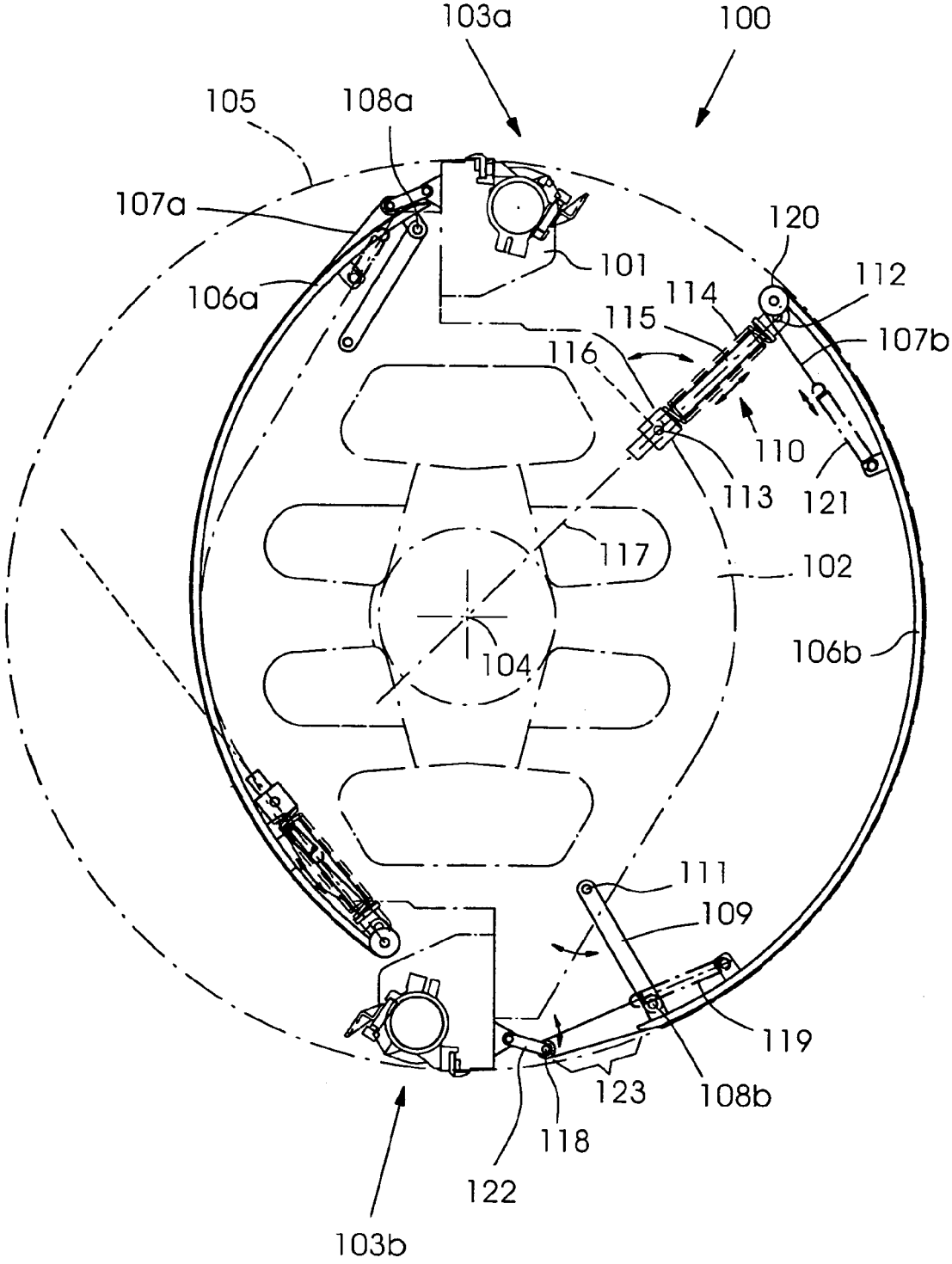
FIGS. 1 and 2 are diagrammatic, sectional views of a first and a second exemplary embodiment, in which sheet supporting elements are flexible and similar to cylinder covers and shell segments are disposed to overlap on the outside and are tensioned by springs.

Referring now to the figures of the drawing in detail and first, particularly, to FIGS. 1-8 thereof, there is shown the common features of whose contents will be described together here, in each case a machine 100, 200, 300, 400, 500, 600, 700 or 800 that processes printing material sheets. The machine is in each case a sheet-fed rotary press having at least two printing units, of which each is an offset printing unit or a flexographic printing unit. The respective detail shows a sheet transport drum designated a vario drum 101, 201, 301, 401, 501, 601, 701 or 801, which is disposed between an impression cylinder of one printing unit and an impression cylinder of the other printing unit. The vario drum is what is known as a double-size drum and contains two gripper systems 103*a*, 103*b* or 203*a*, 203*b* or 303*a*, 303*b* or 403*a*, 403*b* or 503*a*, 503*b* or 603*a*, 603*b* or 703*a*, 703*b* or 803*a*, 803*b* disposed diametrically on a basic drum body 102, 202, 302, 402, 502, 602, 702 or 802 which is profiled substantially rhomboidally, in which gripper systems the printing material sheets are held clamped in for some time and which gripper systems, during rotation of the vario drum about its axis of rotation 104, 204, 304, 404, 504, 604, 704 or 804, move along an imaginary gripper flight circle 105, 205, 305, 405, 505, 605, 705 or 805.

The vario drum contains a first shell segment 106*a*, 206*a*, 306*a*, 406*a*, 506*a*, 606*a*, 706*a* or 806*a* and a second shell segment 106*b*, 206*b*, 306*b*, 406*b*, 506*b*, 606*b*, 706*b* or 806*b*, which have substantially the same radius of curvature as the gripper flight circle 105 and are formed in the manner of shells. Each of the two shell segments extends over a circumferential angle of the vario drum lying between 90° and 120° and preferably between 95° and 115°. A first sheet supporting element 107*a*, 207*a*, 307*a*, 407*a*, 507*a*, 607*a*, 707*a* or 807*a* is assigned to the first shell segment, and a second sheet supporting element 107*b*, 207*b*, 307*b*, 407*b*, 507*b*, 607*b*, 707*b* or 807*b* is assigned to the second shell segment.

Each of the shell segments and the sheet supporting elements is at least as wide in the direction parallel to the axis of rotation of the vario drum as the printing material sheets transported by the vario drum 101. The shell segments and the sheet supporting elements are preferably somewhat wider than the maximum sheet width for which the vario drum 101 is configured. As opposed to the flexible sheet supporting elements, the shell segments, which maintain their circular arc-shaped circumferential contour permanently irrespective of their set pivoting position, are dimensionally stable shells with a high stiffness.

The first shell segment is mounted such that it can be pivoted alternatively about a first rotary joint 108*a*, 208*a*, 308*a*, 408*a*, 508*a*, 608*a*, 708*a* or 808*a*, and the second shell segment is mounted such that it can be pivoted alternatively about a second rotary joint 108*b*, 208*b*, 308*b*, 408*b*, 508*b*, 608*b*, 708*b* or 808*b*, inward, that is to say toward the axis of rotation 104, 204, 304, 404, 504, 604, 704 or 804, and outward, that is to say away from the aforesaid axis of rotation. Each of the two aforementioned rotary joints is disposed at one end of the respective shell segment and very close to one of the gripper systems in each case.

If the two shell segments are folded in for the operation of the vario drum in a first operating mode "board sheet transport", there are between the shell segments and the gripper flight circle 105, 205, 305, 405, 505, 605, 705 or 805 substantially sickle-shaped clearances, into which the printing material sheets project with their sheet trailing edges as the printing material sheets leave the vario drum. The sheet supporting elements, whose shape and position depend on the respective position of the shell segments, are likewise set back from the gripper flight circle when the shell segments are pivoted inward, so that in the first operating mode the sheet supporting elements do not function as such.

In a second operating mode "paper sheet transport" of the vario drum, the shell segments are folded outward and, in the second operating mode, hold the sheet supporting elements substantially congruent with the gripper flight circle. In the second operating mode, the vario drum has a substantially circular drum profile, which is determined by the position assumed by the shell segments in the second operating mode, and the sheet supporting elements function as such, that is to say to carry the printing material sheets.

In FIGS. 1 to 8, the first shell segment is illustrated in its inner pivoted position and the second shell segment in its outer pivoted position, in order in this way to illustrate the two pivoted positions into which each of the two shell segments can be adjusted. In this connection, it goes without saying that the two shell segments are always kept in the pivoted position respectively identical to each other during the operation of the vario drum. For example, in the first operating mode "board sheet transport", not only the first shell segment 106*a*, 206*a*, 306*a*, 406*a*, 506*a*, 606*a*, 706*a* or 806*a* but also, differing from FIGS. 1 to 8, the second shell segment 106*b*, 206*b*, 306*b*, 406*b*, 506*b*, 606*b*, 706*b* or 806*b* is adjusted into the inner pivoted position, so that the drum profile of the vario drum is substantially oval.

The two sheet supporting elements 107*a*, 107*b* or 207*a*, 207*b* or 307*a*, 307*b* or 407*a*, 407*b* or 507*a*, 507*b* or 607*a*, 607*b* or 707*a*, 707*b* or 807*a*, 807*b* have external surfaces which, on account of their material and/or of their surface structure (surface relief), develop an effect which repels the printing ink or the varnish. In other words, at least the circumferential surfaces of the first sheet supporting element and of the second sheet supporting element are anti-smear protective surfaces. In the second operating mode, the printing material sheets rest with their freshly printed sheet sides on these anti-smear protective surfaces without smearing off or being smeared.

The preceding section of the description referred equally to all of the FIGS. 1 to 8 and to features common to all the exemplary embodiments. By contrast, in the following sections, reference will be made to the exemplary embodiments individually or in groups, so that it becomes clear in what respect the exemplary embodiments differ from one another.

Figure 2:
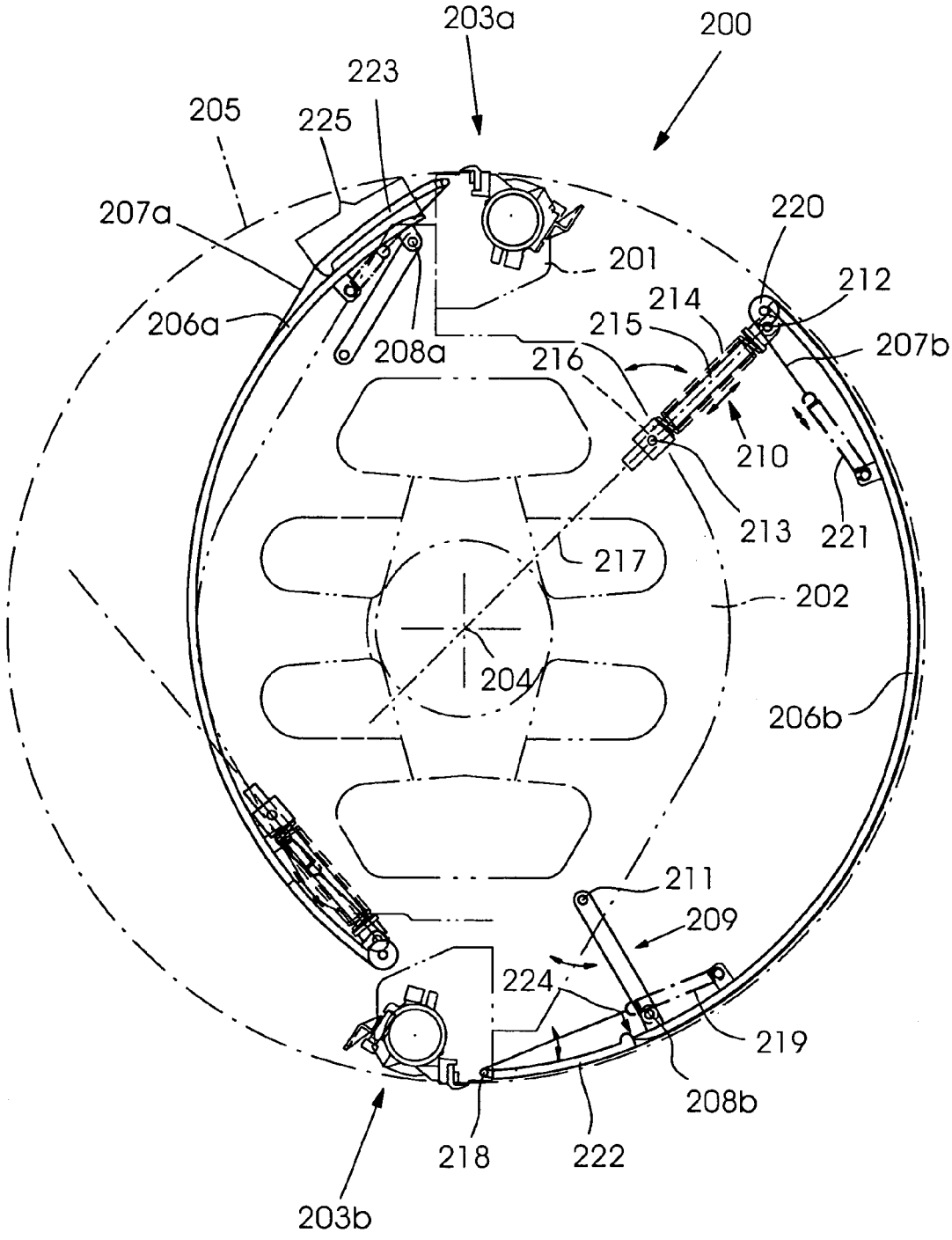

In the exemplary embodiments illustrated in FIGS. 1 and 2, the basic drum body 102 or 202, the second shell segment 106*b* or 206*b*, a first coupler 109 or 209, a second coupler 110 or 210, the second rotary joint 108*b* or 208*b*, a third rotary joint 111 or 211, a fourth rotary joint 112 or 212 and a fifth rotary joint 113 or 213 together form a four-bar linkage. In the latter, the second shell segment is connected in an articulated manner at its leading segment end to the first coupler via the second rotary joint, and at its trailing segment end to the second coupler via the fourth rotary joint. The two couplers are attached to the basic drum body via the third rotary joint and the fifth rotary joint.

The four-bar linkage is constructed as what is known as an over-center tensioning mechanism, which, as is known, is closely related to an over-center device. In this connection, for a better understanding, reference is made to the fact that in the textbook entitled "Konstruktionselemente der Feinmechanik" [Precision Mechanism Constructional Elements] (ISBN 3446-15332-2, Carl-Hanser-Verlag, Munich, Vienna 1989, editor: Werner Krause), on pages 523 and 524, over-center tensioning mechanisms are illustrated and their typical properties are explained extensively. The over-center tensioning mechanism respectively illustrated in FIGS. 1 and 2 is a sprung mechanism in which a first spring 114 or 214 produces what is known as a contact force. As is typical of over-center tensioning mechanisms, a change in the direction of the contact force (spring force) that takes place when the mechanism dead-center position (over-center position) is exceeded is used to hold the over-center tensioning mechanism by the contact force alternatively both in a position below dead center and in a position above dead center.

The first spring 114 or 214 is a compression spring wound in a spiral and pushed onto a rod 115 or 215 of the second coupler. Such rod-spring combinations are also referred to as spring rods. The first spring is held under prestress on the rod, by the first spring being supported by one spring end on the fourth rotary joint 112 or 212, more precisely on an eye of the rod 115 or 215, and by its opposite spring end being supported on a thrust joint 116 or 216, more precisely on a small bearing block. In order to form a thrust joint 116 or 216, the rod is inserted into the small bearing block such that it can be displaced linearly along its longitudinal rod axis and the small bearing block is connected in an articulated manner to the basic drum body 102 or 202 via the fifth rotary joint 113 or 213.

The over-center tensioning mechanism further contains a first stop and a second stop, the two stops not being specifically illustrated in the drawing. The first stop is disposed on the basic drum body and is used to limit the pivoting movement of the first coupler 109 or 209, taking place when the second shell segment is pivoted outward in the counterclockwise direction and about the third rotary joint 111 or 211, and to determine the end position, in each case illustrated in FIGS. 1 and 2, of the first coupler. The second stop is disposed on the first coupler 109 or 209 and is used to limit the pivoting movement taking place when the second shell segment is pivoted outward about the second rotary joint 108*b* or 208*b* in the clockwise direction, and to determine the end position, in each case shown in FIGS. 1 and 2, of the second shell segment 106*b* or 206*b*.

The first shell segment 106*a* or 206*a* is a constituent part of a further four-bar linkage and over-center tensioning mechanism of the vario drum 101 or 201, which is structurally identical to the four-bar linkage and over-center tensioning mechanism previously described in detail, whose constituent part is the second shell segment 106*b* or 206*b* and, on this basis, does not need to be described in detail as well. In other words, the drum half of the vario drum on the left with respect to FIGS. 1 and 2 corresponds completely in constructional terms to its right-hand drum half, the two drum halves being constructed to be offset in relation to each other by a center angle which is 180° and is to be related to the axis of rotation 104 or 204. An imaginary connecting center line 117 or 217 runs through mid-axes of the fourth rotary joint 112 or 212 and of the fifth rotary joint 113 or 213 and is congruent with the longitudinal rod axis of the rod 115 or 215.

If the connecting center line, in its imaginary extension, does not extend through between the second rotary joint 108*b* or 208*b* and the third rotary joint 111 or 211 (or, in other words, does not cross the first coupler 109 or 209), then the respective over-center tensioning mechanism is in its position below dead center or in its position above dead center. Which of the two positions (below dead center position, above dead center position) the over-center tensioning mechanism assumes depends in each case on whether the second rotary joint and the third rotary joint and the first coupler are located on one side or the other of the connecting center line, that is to say, in relation to FIGS. 1 and 2, on the right or left of the connecting center line.

Using the example of the over-center tensioning mechanism containing the second shell segment 106*b* or 206*b*, it is shown that the over-center tensioning mechanism is in the position below dead center when the second shell segment is in its outer pivoted position and when, at that time, the first rotary joint, the third rotary joint and the first coupler are on the right of the connecting center line. In this case, the connecting center line 117 or 217 is oriented substantially radially with respect to the vario drum and with respect to the respective shell segment.

Using the example of the other over-center tensioning mechanism, which contains the first shell segment 106*a* or 206*a*, the position above dead center is illustrated, in which the first rotary joint 108*a* or 208*a* and the coupler (spring rod) associated with the first shell segment are located on the left of the connecting center line. In this position above dead center, the respective shell segment, in the given example therefore the first shell segment 106*a* or 206*a*, is displaced into its inner pivoted position, and the connecting center line is oriented substantially in the manner of a secant with respect to the vario drum and with respect to the respective shell segment. The over-center tensioning mechanism containing the second shell segment 106*b* is located in the mechanism dead center position (over-center position) when, during the pivoting of the second shell segment, the first coupler is connected in a line to the connecting center line or when, at that time, the second, third, fourth and fifth rotary joints are located on one and the same imaginary straight line. In this mechanism dead center position, the distance between the fourth rotary joint 112 or 212 and the fifth rotary joint 113 or 213 is the smallest, as compared with the other mechanism positions, and accordingly the first spring 114 or 214 is prestressed or compressed to the greatest extent.

The first spring 114 or 214 is disposed in such a way that, in the first operating mode, it holds the second shell segment 106*b* securely in the inner pivoted position or position above dead center and, in the second operating mode, holds it securely in the outer pivoted position or position below dead center. The first coupler 109 or 209, which can also be designated what is known as a spring rod, is a variable-length coupler, as emerges from the preceding explanations.

The alignment of the second shell segment concentrically with the gripper flight circle 105 or 205 in the outer pivoted position of the shell segment is ensured by a securing device, not specifically illustrated. This also prevents the rod 115 or 215 sliding out of the thrust joint 116 or 216, this being caused by the first spring, and can, for example, contain a transverse pin which is inserted into the end of the rod 115, 215 which projects out of the small bearing block of the thrust joint and, in the course of the displacement of the rod in the small bearing block, strikes the latter and thus limits the thrust travel of the rod.

The sheet supporting elements 107*a*, 107*b* or 207*a*, 207*b* are flexible and similar to cylinder covers. The sheet supporting elements preferably formed of a textile material, for example a fabric or a nonwoven. That fabric which forms the top layer of the anti-smear system marketed under the trademark SUPERBLUE® is particularly suitable for the sheet supporting elements 107*a*, 107*b* or 207*a*, 207*b*.

Each of the two sheet supporting elements 107*a*, 107*b* or 207*a*, 207*b* is tensioned over another of the two shell segments 106*a*, 106*b* or 206*a*, 206*b*, as will be explained in detail below using the example of the second sheet supporting element 107*b* or 207*b*. The second sheet supporting element 107*b* or 207*b* is deflected with its leading cover end over a first deflection element 118 or 218 to a second spring 119 or 219 and is deflected with its trailing cover end over a second deflection element 120 or 220 to a third spring 121 or 221. Each of the two last-named springs 119, 121 or 219, 221 is disposed in a multiple configuration, that is to say in a row of springs parallel to the axis of rotation 104 or 204. The two springs 119, 121 or 219, 221 are tension springs and are fixed under prestress by one of their spring end to the second shell segment 106*b* or 206*b*, more precisely to the inner side of the latter, and by their other spring end to the respective deflected cover end. The springs 119, 121 or 219, 221 disposed underneath the second shell segment 106*b* or 206*b* in two rows of springs in parallel to the drum axis hold the second sheet supporting element 107*b* or 207*b* tensioned tautly on the second shell segment. The second deflection element 120 or 220 is a deflection roller fixed such that it can rotate to the segment end of the second shell segment that trails in the direction of rotation of the vario drum and extends over the entire format width. The second deflection element 120 or 220 could also be a deflection rod instead of the deflection roller.

As can be seen in FIG. 1, the first deflection element 118 of the first exemplary embodiment is attached to the gripper system 103*b* via a lever-like lug 122 and, instead, could also be attached to the basic drum body 102 via the lug 122. The first deflection element 118 extends, in exactly the same way as the second deflection element 120, parallel to the axis of rotation 104 over the entire width of the second shell segment 106*b* and also that of the second sheet supporting element 107*b*. The first deflection element 118 is a roller mounted in the lug 122 such that it can rotate and, instead, could also be a rod.

The second sheet supporting element 107*b* has a self-supporting section 123 that reaches from the leading segment edge of the second shell segment 106*b* as far as the first deflection element 118. In the region of the self-supporting section 123, the second sheet supporting element is unsupported on the underside, that is to say from the interior of the drum. The deviation, caused by the rectilinear tensioning of the self-supporting section 123 in the region of the latter, of the external contour of the drum profile of the vario drum 101 from the ideal circular shape desired in the second operating mode does not impair the function because of the short length of the self-supporting section 123 as compared with the sheet length of the second shell segment 106*b*, and is therefore acceptable.

In the second exemplary embodiment shown in FIG. 2, the first deflection element 218 is the lengthened hinge pin of a rotary joint, around which a third shell segment 222 is mounted such that it can pivot inward and outward. In exactly the same way as the second shell segment 206*b* is assigned the third shell segment 222, the first shell segment 206*a* is assigned a fourth shell segment 223, which is identical in constructional and functional terms to the third shell segment 222. The third shell segment 222 is shell-like, and the outer circumferential surface of the third shell segment 222 has the same radius of curvature as that of the second shell segment 206*b*. The rotary joint that contains the first deflection element 218 and via which the third shell segment 222 is attached to the gripper system 203*b* and, instead, could also be attached to the basic drum body 202, is located on that end of the third shell segment 222 which leads in the direction of rotation of the vario drum. The trailing end of the third shell segment 222, together with the leading end of the second shell segment 206*b*, forms a separable joint 224 as soon as the shell segments 206*b*, 222 are both pivoted outward for the purpose of implementing the second operating mode. However, the separable joint 224 cannot impair the non-illustrated printing material sheet which is resting on the second sheet supporting element

207*b* in the second operating mode and extends over the separable joint 224, since the second sheet supporting element 207*b* between the printing material sheet and the separable joint 224 extends beyond the latter and, as a result, covers the latter. The second sheet supporting element 207*b* is tensioned over the two mutually associated shell segments 206*b*, 222. If the two mutually associated shell segments 206*b*, 222 are pivoted inward in order to implement the first operating mode, there is an overlap 225 between these shell segments in exactly the same way as shown using the example of the two other mutually associated shell segments 206*a*, 223 in FIG. 2. The springs 219, 221 ensure that the sheet supporting element is seated tautly even when the shell segments 206*b*, 222 are pivoted inward. When the two shell segments 206*b*, 222 are pivoted outward, the overlap of the two shell segments is lost and, accordingly, the tension of the springs 219, 221 is increased.

The third shell segment 222 and the fourth shell segment 223 can also be formed as a pair of levers in each case, in a departure from the exemplary embodiment illustrated. The pair of levers contains two levers which are disposed outside the format width and between which the respective sheet supporting element 207*a* or 207*b* forms a self-supporting section.

In the exemplary embodiments illustrated in FIGS. 3 to 8, an actuating element 309, 409, 509, 609, 709 or 809 in the shape of a circular ring is mounted coaxially with the axis of rotation 304, 404, 504, 604, 704 or 804 and on the basic drum body 302, 402, 502, 602, 702 or 802 such that it can rotate relative to the latter. A first coupler 310*a*, 410*a*, 510*a*, 610*a*, 710*a* or 810*a* is connected to the actuating element by its one coupler end in a rotationally articulated manner and is attached to the first shell segment 306*a*, 406*a*, 506*a*, 606*a*, 706*a* or 806*a* by its other coupler end. In an analogous way, a second coupler 310*b*, 410*b*, 510*b*, 610*b*, 710*b* or 810*b* is attached to the actuating element by its one coupler end and is attached to the second shell segment 306*b*, 406*b*, 506*b*, 606*b*, 706*b* or 806*b* by its other coupler end in a rotationally articulated manner. The first and second couplers are connected to the shell segments at their segment ends opposite to the rotary joints 308*a*, 308*b* or 408*a*, 408*b* or 508*a*, 508*b* or 608*a*, 608*b* or 708*a*, 708*b* or 808*a*, 808*b*. Although this cannot readily be seen from FIGS. 3 to 8, in which in each case the two drum halves are illustrated in mutually different settings, the first and second couplers are actually attached to the actuating element at diametrically opposite attachment points, so that rotation of the actuating element about the axis of rotation in the clockwise direction with respect to FIGS. 3 to 8 effects synchronous folding-out of the shell segments, and rotation in the opposite direction of the actuating element effects synchronous folding-in of all the shell segments. By the central actuating element, both drum halves can thus be widened or contracted simultaneously, depending on the direction of rotation of the actuating element.

Figure 3:
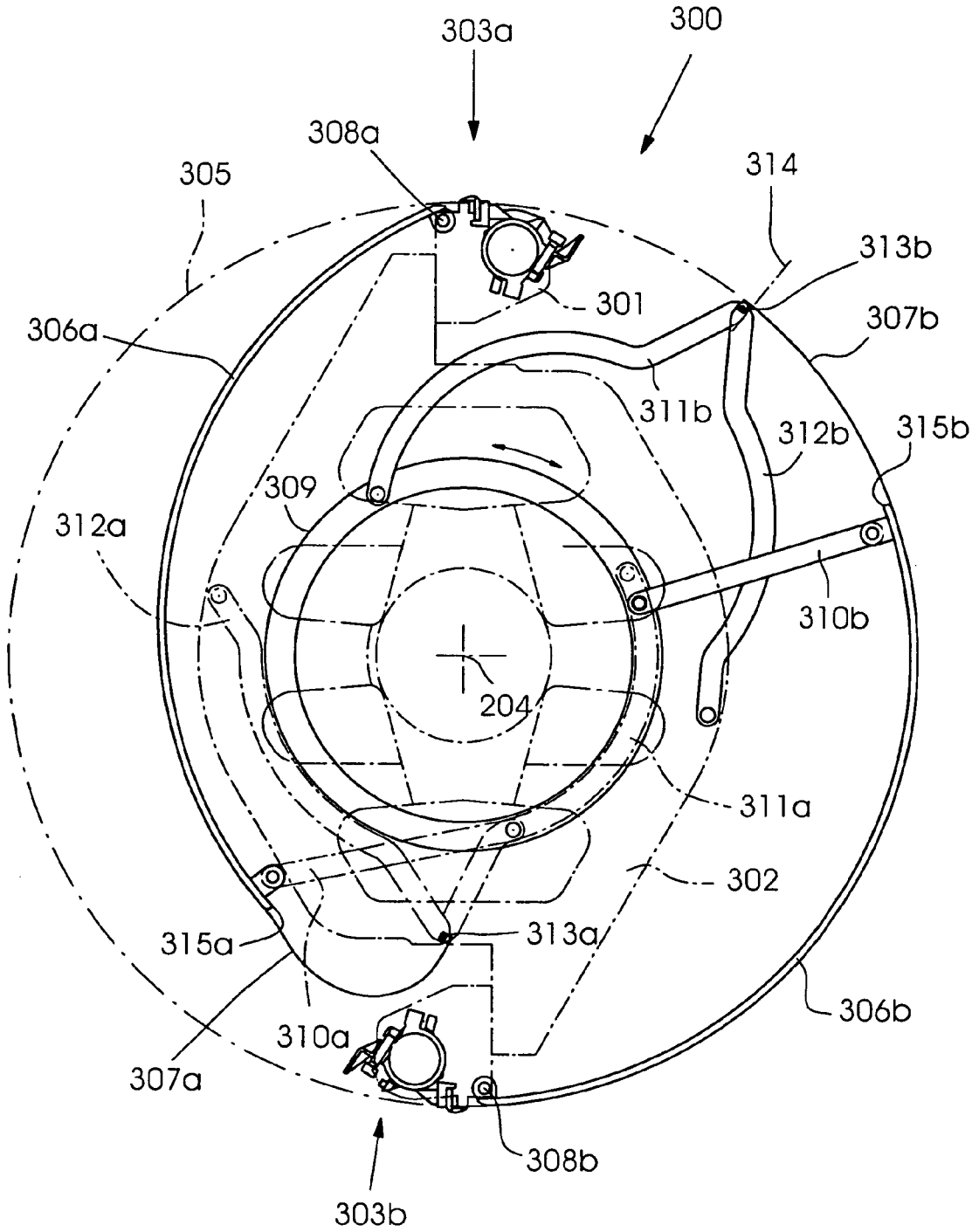
FIGS. 3 and 4 are diagrammatic, sectional views of a third and fourth exemplary embodiment, in which the sheet supporting elements are flexurally elastic and similar to leaf springs.
Figure 4:
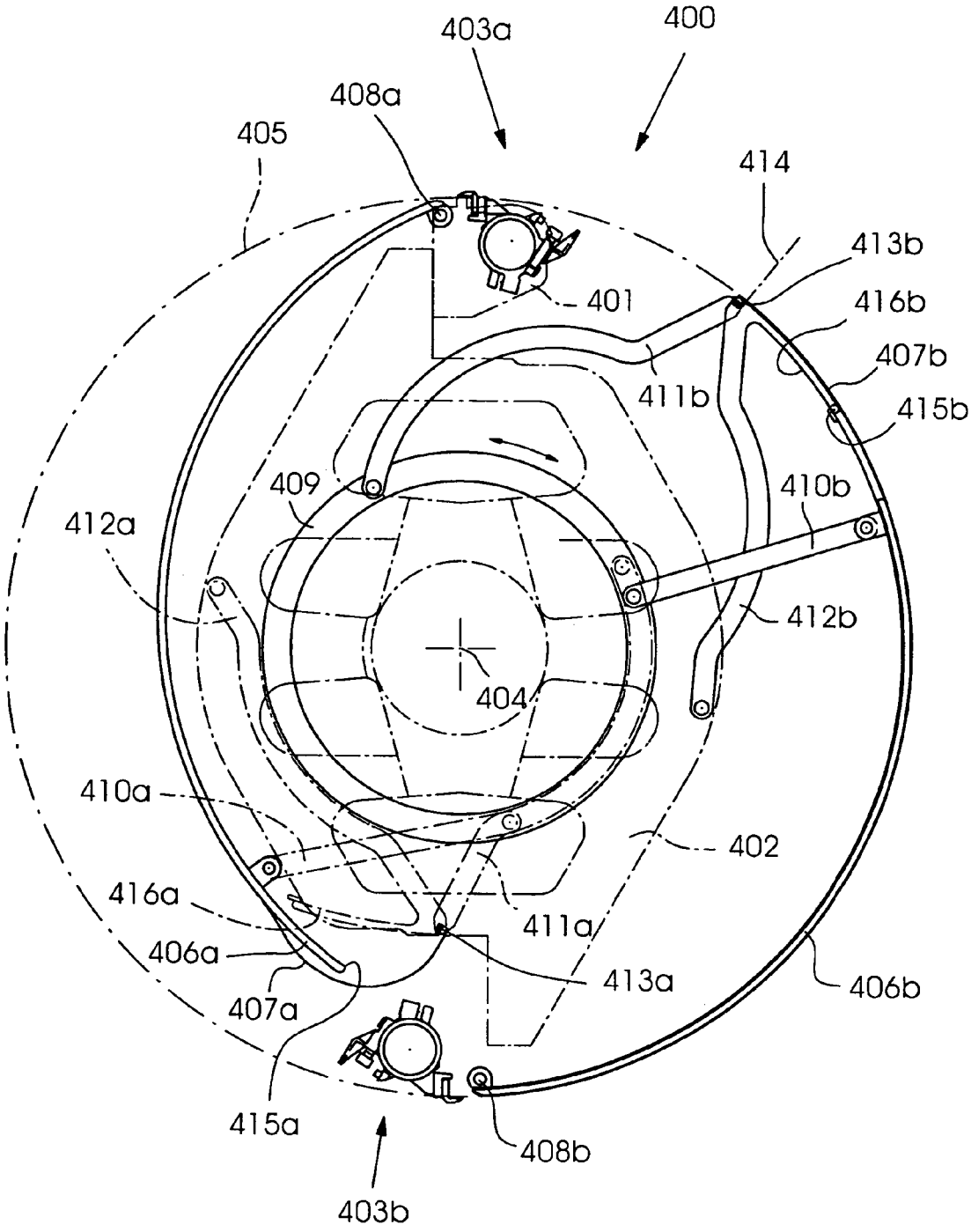

In the exemplary embodiments according to FIGS. 3 and 4, a third coupler 311*a* or 411*a* and a fourth coupler 311*b* or 411*b* are attached to the actuating element 309 or 409 so as to be offset with respect to the first and second couplers and diametrically opposite each other. In addition, a first swinging arm 312*a* or 412*a* and a second swinging arm 312*b* or 412*b* are attached to the basic drum body 302 or 402 with their inner swinging ends diametrically opposite each other. The third coupler and the first swinging arm are connected to each other at their outer ends via a third rotary joint 313*a* or 413*a*. Likewise, the fourth coupler and the second swinging arm are attached to each other via a fourth rotary joint 313*b* or 413*b*. The third and fourth couplers 311*a*, 311*b* or 411*a*, 411*b* and also the two swinging arms 312*a*, 312*b* or 412*a*, 412*b* each have a curvature which is matched to the actuating element 309 or 409. The coupler and swinging-arm curvatures are concentric with the curvature of the actuating element when the couplers 311*a*, 311*b* or 411*a*, 411*b* and swinging arms 312*a*, 312*b* or 412*a*, 412*b* are folded inward in the first operating mode. Concave inner surfaces of the swinging arms rest with an exact fit on a convex outer surface of the actuating element, as illustrated in FIGS. 3 and 4 using the example of the first swinging arm. The actuating element, the third coupler and the first swinging arm together form a first four-bar linkage, the actuating element functioning as its drive swinging arm. The actuating element likewise functions as the drive swinging arm of a second four-bar linkage, which is formed by the actuating element, the fourth coupler and the second swinging arm together. Although the shell segments 306*a*, 306*b* or 406*a*, 406*b* are shorter than the maximum permissible printing length for the vario drum which the printing material sheet can have, they are lengthened by the sheet supporting elements 307*a*, 307*b* or 407*a*, 407*b* at least as far as the end 314 or 414 of the print. In the transferred sense, this also applies to the shell segments and sheet supporting elements of the other exemplary embodiments shown in FIGS. 5 to 8.

The first sheet supporting element 307*a* or 407*a* covers the first shell segment 306*a* or 406*a* substantially over its entire segment length from the first rotary joint 308*a* or 408*a* as far as a trailing segment edge 315*a* or 415*a* and extends beyond the latter as far as the mutually attached ends of the third coupler 311*a* and the first swinging arm 312*a* and thus as far as the third rotary joint 313*a*. The first sheet supporting element 307*a* or 407*a* can, for example, be adhesively bonded to the first shell segment 306*a* or 406*a* or fixed to it in another way. The second sheet supporting element 307*b* or 407*b*, which not only extends longitudinally from the second rotary joint 308*b* or 408*b* to a trailing segment edge 315*b* or 415*b* over substantially the entire second shell segment 306*b* or 406*b* but projects beyond the segment edge 315*b* or 415*b* and reaches as far as the fourth rotary joint 313*b* or 413*b*, is fixed to the second shell segment by adhesive bonding or the like. The two sheet supporting elements 307*a*, 307*b* or 407*a*, 407*b* are configured to be flexible similarly to leaf springs and, for example, are spring plates or flexurally elastic plastic films. On these sheet supporting elements there is in each case an anti-smear surface that repels the printing ink, either in the form of a coating (for example matt or structured chromium plating) of the sheet supporting element or a textile cylinder cover (for example SUPERBLUE®) fixed to the latter. On account of appropriately dimensioned joint spacings of the joints of the four-bar linkages in relation to one another, sections of the sheet supporting elements, which reversibly deform (deformation sections) when the shell segments are displaced, are kept curved and substantially congruent with the gripper flight circle 305 or 405 when the sheet supporting elements and shell segments are displaced into their position remote from the drum center, as shown in FIGS. 3 and 4 using the example of the second sheet supporting element 307*b* or 407*b*, and, in contrast, are kept much more highly curved when the sheet supporting elements and shell segments are displaced into their position close to the drum center, as illustrated in the drawing using the example of the first sheet supporting element 307*a* or 407*a*. The deformation sections of the sheet supporting elements begin approximately at the rotary joints connecting the first and second couplers to the shell segments and end approximately at the third and fourth rotary joints.

In the third exemplary embodiment according to FIG. 3, the deformation sections preserve their setting position, which is substantially congruent with the gripper flight circle 305 for the second operating mode on their own on account of their inherent stiffness and prestress. That is to say without any support on the underside; the deformation sections are therefore self-supporting.

As opposed to this, in the fourth exemplary embodiment according to FIG. 4, a third shell segment 416*a* and a fourth shell segment 416*b* are disposed at the ends of the swinging arms 412*a*, 412*b*.

Instead, differing from the exemplary embodiment illustrated, the third and fourth shell segments could also be disposed at the ends of the third coupler 411*a* and the fourth coupler 411*b*.

The shell segments 416*a*, 416*b* carried by the four-bar linkages in FIG. 4 are approximately half as long as the deformation sections and thus much shorter than the other two shell segments 406*a*, 406*b*, and are curved in a corresponding manner to these. In the case of the vario drum contracted for the first operating mode "board sheet transport", the third and fourth shell segments overlap with the first and second shell segments and are underneath the latter. In the case of the vario drum widened for the second operating mode "paper sheet transport", leading edges of the third and fourth shell segments together with the trailing segment edges 415*a*, 415*b* of the first and second shell segments form separable joints which are covered on the outside by the sheet supporting elements and their deformation sections and thus cannot cause any markings in the printed image of the printing material sheet. The third shell segment 416*a* and the fourth shell segment 416*b* are shorter in the circumferential direction than the other two shell segments 406*a*, 406*b*, are used to stabilize the shape of the deformation sections and extend over the entire format width.

However, the latter is not necessary in every case since, in the case of a sufficient inherent stiffness of the sheet supporting elements, the third and fourth shell segments, as could be formed as carrying bows supporting the sheet supporting elements on the underside only in the region of their side edges, which carrying bows are then, of course, substantially narrower than the format width.

In the third and fourth exemplary embodiments, the sheet supporting elements 307*a*, 307*b* or 407*a*, 407*b*, in a departure from the technical solution illustrated in the drawing, could be fitted to the segment edges 315*a*, 315*b* or 415*a*, 415*b* and thus the shell segments would be disposed not to overlap at all or to overlap only incompletely. The smooth joints present here, for example, in the region of the segment edges 315*a*, 315*b* or 415*a*, 415*b* can be filled up with adhesive or the like and ground or remachined in another way after the sheet supporting elements have been joined to the shell segments, so that the remachined smooth joints likewise cannot cause any markings in the printed image.

The sheet supporting elements 507*a*, 507*b* or 607*a*, 607*b* or 707*a*, 707*b* or 807*a*, 807*b* of the fifth to eighth exemplary embodiments are also configured to be similar to leaf springs and thus flexurally elastic. These sheet supporting elements can be spring plates or flexible plastic films and are provided with ink-repellent anti-smear outer surfaces. The sheet supporting elements can contain a plurality of layers which are applied to one another undetachably and of which the outermost layer (top layer) has the ink-repellent material properties and/or structure properties. The sheet supporting elements can instead also be formed of a plurality of plies which are stacked loosely on one another (sandwich arrangement) and of which the outermost ply (top ply) again has the aforesaid ink-repellent properties. The sheet supporting elements, which are adhesively bonded to the shell segments or firmly connected in another way, cover the shell segments 506*a*, 506*b* or 606*a*, 606*b* or 706*a*, 706*b* or 806*a*, 806*b* lying underneath them substantially completely and, instead, could be joined end to end to the trailing segment edges of the shell segments, forming smooth joints which are leveled by remachining. When the shell segments are pivoted outward in order to determine the circular drum profile, deformation sections 511*a*, 511*b* or 611*a*, 611*b* or 711*a*, 711*b* or 811*a*, 811*b* of the sheet supporting elements are substantially congruent with the gripper flight circle 505, 605, 705 or 805. In this case, the deformation sections keep their circular arc shape matched to the gripper flight circle in a self-supporting manner. This outward curvature of the deformation sections results on account of the prestress under which the deformation sections are in each case held at their one end by the corresponding shell segment and at their other end by another element of the vario drum, and on account of the inherent stiffness and stability of the sheet supporting elements and deformation sections. In the connection explained above, the same therefore applies to the exemplary embodiments illustrated in FIGS. 5 to 8 as in the exemplary embodiments illustrated in FIGS. 3 and 4. However, the exemplary embodiments illustrated in FIGS. 5 to 8 differ from the latter in some important features, which will be explained in detail in the following text.

Figure 5:
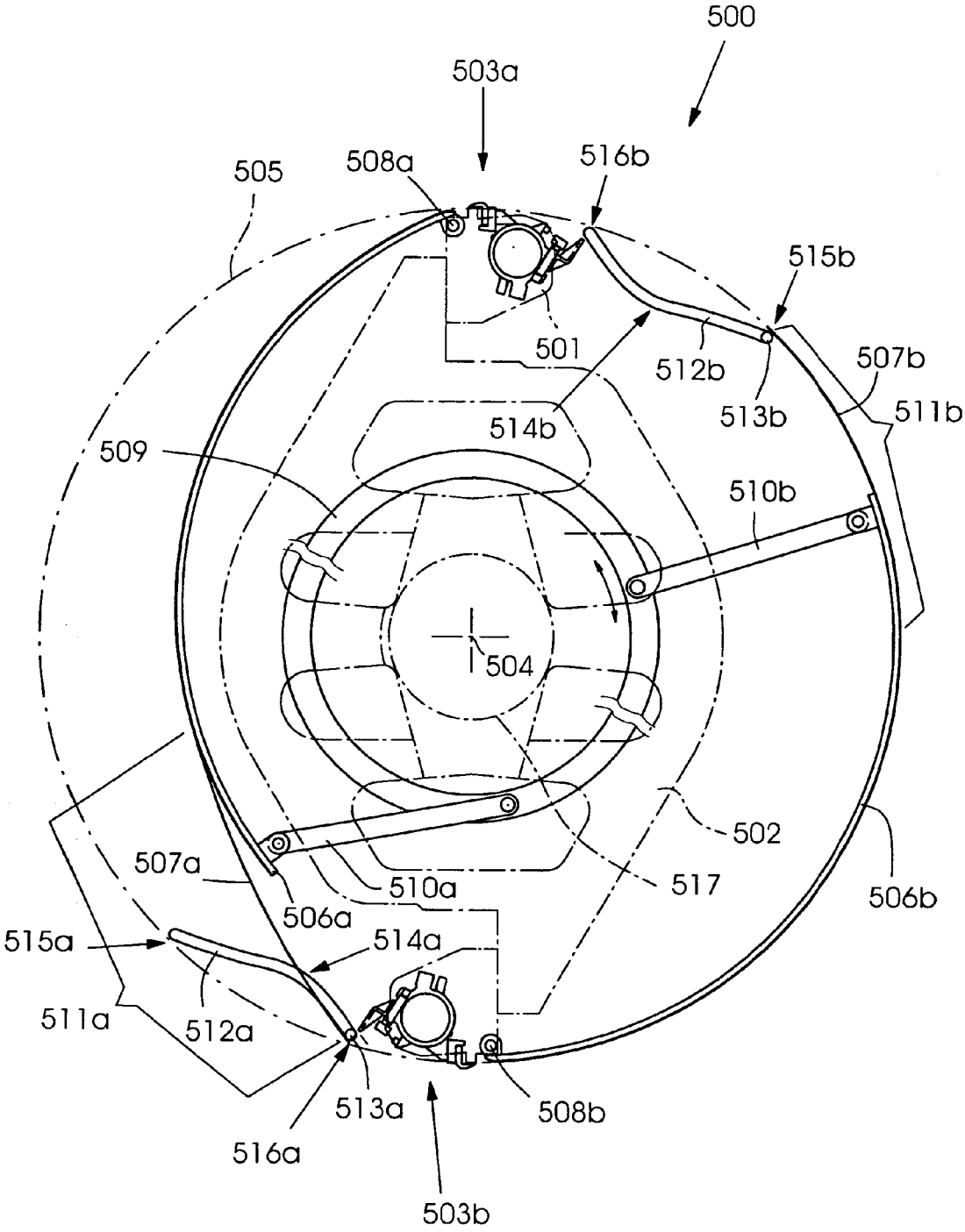
FIGS. 5 and 6 are diagrammatic, sectional views of a fifth and a sixth exemplary embodiment, in which the sheet supporting elements have self-supporting deformation sections by which the drum profile is determined.
Figure 6:
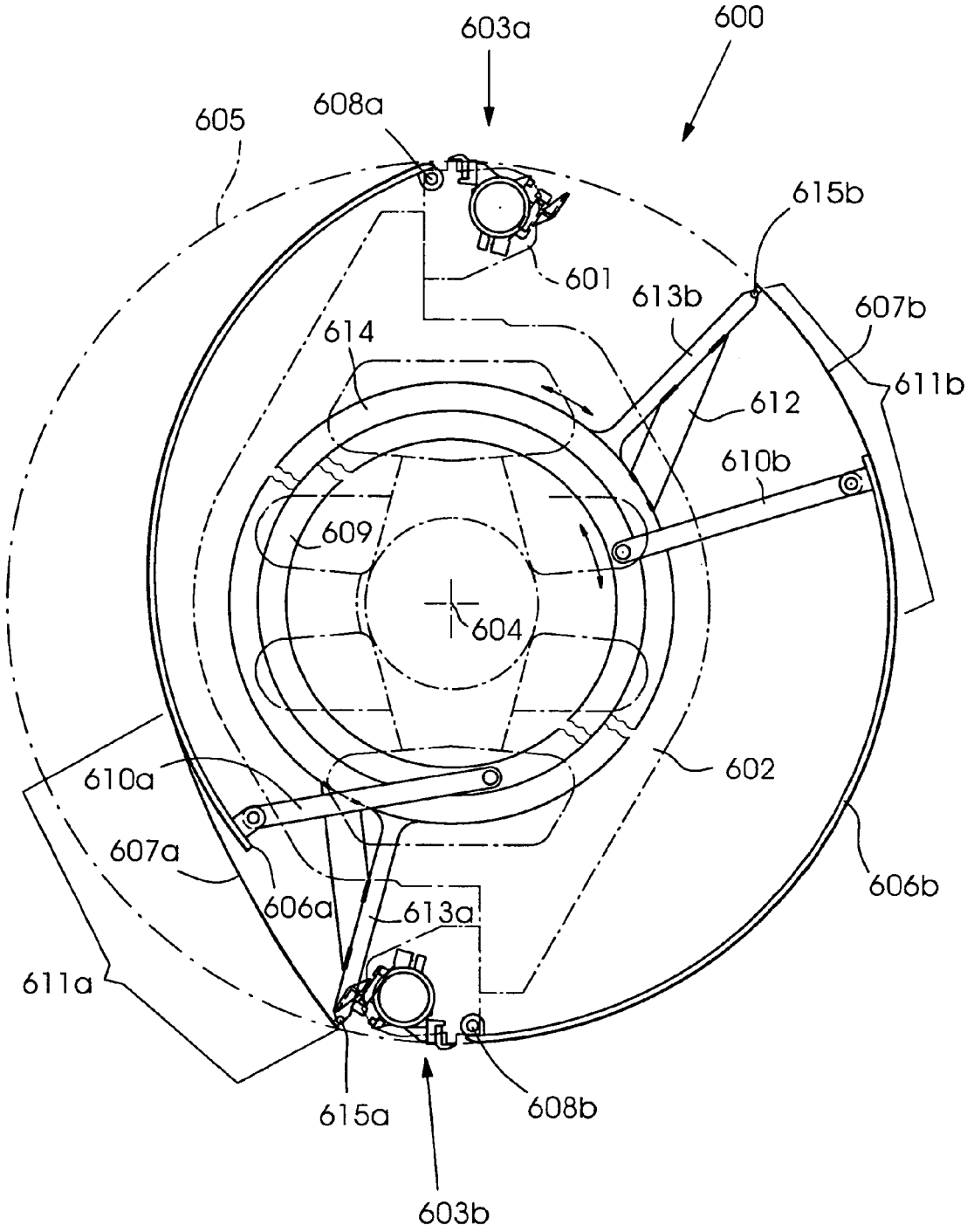

In the fifth and sixth exemplary embodiments according to FIGS. 5 and 6, when the shell segments and sheet supporting elements are pivoted inward, the curvature of the deformation sections is lower than when the shell segments and sheet supporting elements are pivoted outward, as illustrated in the drawing using the example of the first sheet supporting element 507*a* or 607*a* and its deformation section 511*a* or 611*a*. The element that determines the intensity of the curvatures and prestresses of the respective deformation section is a different one in the fifth exemplary embodiment than in the sixth.

In the fifth exemplary embodiment, the element is in each case a cam track 512*a*, 512*b*, along which a trailing edge of the sheet supporting element and a cam follower element 513*a*, 513*b* disposed on the sheet supporting element, that is to say fixed or integrally molded, are forcibly guided during the displacement of the sheet supporting element. The cam track is curved convexly with respect to the axis of rotation 504 and, approximately at its center, has a point of inflection 514*a*, 514*b* which is at a different (greater) distance than end points 515*a*, 515*b*; 516*a*, 516*b* of the cam track relative to the gripper flight circle 505, that is to say to the drum periphery line. The cam track is a cam groove which is introduced into a non-illustrated slotted guide which is disposed in the drum axial direction, that is to say at right angles to the plane of FIG. 5, offset with respect to the sheet supporting elements and shell segments, beside the latter and thus outside the maximum permissible sheet format width, and is firmly connected to the basic drum body 502, for example via an axle journal 517, so as to rotate with it. The cam follower element is a cam roller that runs in the cam groove and could instead also be a pin-like sliding block. The two end points of the cam track are stop surfaces for the cam follower element. In FIG. 5, by way of example and with validity in the transferred sense for the respective other drum half, it is shown that the cam follower element rests on the stop surface (end point 516*a*, 516*b*) located further to the rear in the drum rotation direction when the sheet supporting element is displaced inward, and rests on the front stop surface (end point 515*a*, 515*b*) when the sheet supporting element is displaced outward. The cam follower element 513*a*, 513*b* and thus the trailing edge of the sheet supporting element carrying the latter is held, on account of its prestress, in that one of the end points which corresponds to the respectively selected setting. During the displacement of the shell segment outward or inward, the cam follower element slides or rolls along the cam track from one end point to the other, a change of direction of the action of force of the spring force of the sheet supporting element which is exerted on the cam follower element taking place at the point of inflection ("over-center point") 514*a*, 514*b*, that is to say a tilting of the mechanical system which is comparable with an over-center tensioning mechanism or over-center device.

In the sixth exemplary embodiment (see FIG. 6), the aforementioned element which determines the prestresses and curvatures of the deformation sections 611*a*, 611*b* is a central swinging arm 612, which is mounted coaxially on the basic drum body 602 such that it can rotate around the axis of rotation 604 relative to the actuating element 609 and to the basic drum body 602. The swinging arm 612 has two carrier arms 613*a*, 613*b* which are disposed diametrically opposite on a bearing ring 614 which belongs to the swinging arm 612 and is rotatably mounted concentrically with the actuating element 609. On account of the type of illustration selected for FIG. 6, merely in order to illustrate the two drum profile settings into which each of the two drum halves can be displaced, it cannot readily be seen therein that the two carrier arms 613*a*, 613*b* are actually disposed offset by 180° with respect to each other and are aligned with each other. The carrier arms 613*a*, 613*b* are connected rigidly (not in an articulated manner) to the bearing ring 614, by being welded to the latter or, instead, could be produced in one piece together with the bearing ring 614. The sheet supporting elements 607*a*, 607*b* are connected to the swinging arm 612 and to the ends of the carrier arms 613*a*, 613*b* at their trailing edges via a third rotary joint 615*a* and a fourth rotary joint 615*b*. The actuating element and the swinging arm are displaced in a common rotational or pivoting direction (clockwise direction with respect to FIG. 6) in the case of enlarging the drum profile, and in the opposite direction in the case of reducing the size of the drum profile. The rotational angle corresponding to which the actuating element 609 is displaced for the purpose of folding the shell segments in and out is greater than the pivoting angle corresponding to which the swinging arm 612 is pivoted for the purpose of displacing the sheet supporting elements. Both during the displacement of the actuating element 609 and of the swinging arm 612 for the purpose of enlarging the drum profile and also for the purpose of reducing the size of the drum profile, the coupler ends of the couplers 610*a*, 610*b* attached to the actuating element 609 "overtake" the carrier arms 613*a*, 613*b* and their rotary joints 615*a*, 615*b*, and fold the couplers 610*a*, 610*b* in or out, depending on the displacement direction. The carrier arms 613*a*, 613*b* maintain their substantially radial alignment during these displacements, however. Because of this change in the position of the couplers 610*a*, 610*b* relative to the carrier arms 613*a*, 613*b*, which is brought about by the displacements the deformation sections 611*a*, 611*b* are curved and prestressed in the required manner.

Figure 7:
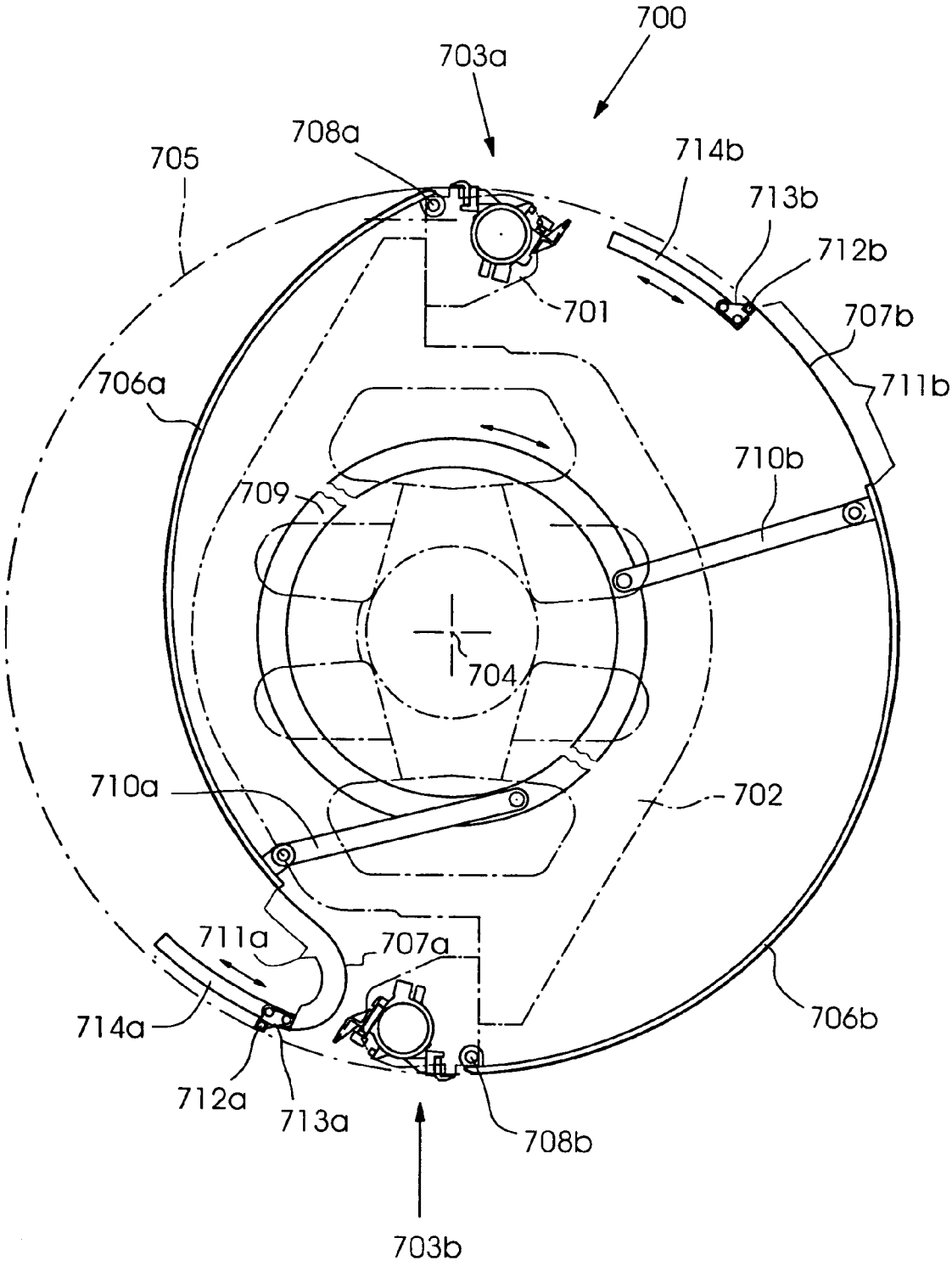
FIGS. 7 and 8 are diagrammatic, sectional views of a seventh and an eighth exemplary embodiment, in which the sheet supporting elements are concave when the shell segments are pivoted inward and are convex when the shell segments are pivoted outward.
Figure 8:
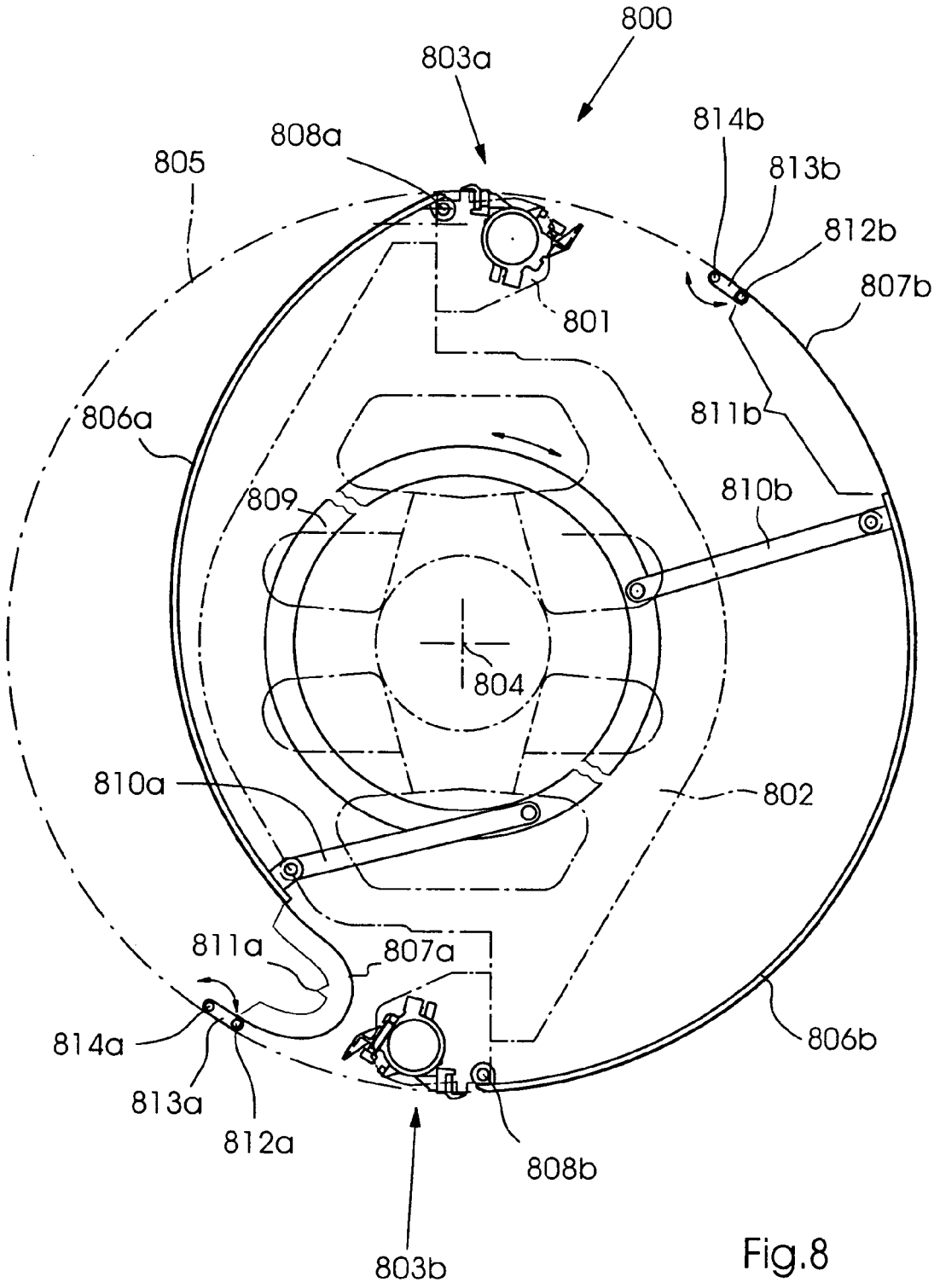

In the exemplary embodiments illustrated in FIGS. 7 and 8, the deformation sections 711*a*, 711*b* or 811*a*, 811*b* are curved inward concavely and comparatively intensely, as shown using the example of the deformation section 711*a* or 811*a*, when the two sheet supporting elements 707*a*, 707*b* or 807*a*, 807*b* are displaced inward together with the two shell segments 706*a*, 706*b* or 806*a*, 806*b* and, otherwise, are curved comparatively weakly, specifically matched to the gripper flight circle 705 or 805, and convexly, as shown using the example of the other deformation section 711*b* or 811*b*. An abrupt changeover ("snip-snap" effect) of the sheet supporting elements or of their deformation sections from their convex to their concave form and from the latter back into the former takes place in the course of the corresponding displacements of the sheet supporting elements. The sheet supporting elements 707*a*, 707*b* or 807*a*, 807*b* are adhesively bonded or connected in another way to the shell segments 706*a*, 706*b* or 806*a*, 806*b* over substantially the entire sheet length of the latter, that is to say as far as the trailing segment edges of the shell segments. In order to achieve the situation where the deformation sections are forcibly curved over into the concave and convex form by the pivoting of the shell segments, the sheet supporting elements are respectively fitted to a holding element at their trailing edges via a third rotary joint 712*a* or 812*a* and a fourth rotary joint 712*b* or 812*b*. The two holding elements are disposed such that they can be displaced relative to the basic drum body 702 or 802 by joints which, for example, are disposed on or in a non-illustrated side plate of the vario drum.

According to the seventh exemplary embodiment, the holding elements are sliders 713*a*, 713*b* and the joints are thrust joints 714*a*, 714*b* which run concentrically with the gripper flight circle 705 and have circular arc-shaped grooves, in which the sliders 713*a*, 713*b* in each case slide or preferably roll from one groove end point serving as a slider stop for holding the convex deformation section deflection as far as the opposite groove end point likewise serving as a stop for the slider and for holding the concave deformation section deflection.

According to the eighth exemplary embodiment, the holding elements are levers 813*a*, 813*b* and the joints are accordingly a fifth rotary joint 814*a* and a sixth rotary joint 814*b* via which rotary joints 814*a*, 814*b* the levers are pivotably mounted in the aforementioned side plate.

Finally, some modifications not specifically illustrated should be mentioned briefly. In the exemplary embodiments illustrated in FIGS. 3, 4, 7 and 8, the sheet supporting elements can be provided with what are known as flex notches, that is to say with grooving similar to corduroy or with beads similar to corrugated paperboard, the grooves or beads extending longitudinally parallel to the axis of rotation of the drum, that is to say at right angles to the figure plane of the aforementioned figures, so that the flexibility and stiffness of the sheet supporting elements depends on the direction. This is because the sheet supporting elements profiled in this way are comparatively very flexurally rigid in the direction parallel to the axis of rotation of the drum and comparatively very flexible in the direction at right angles to the axis of rotation of the drum. In other words, the sheet supporting elements can be curved in the plane of the figures without relatively great expenditure of force and, in spite of this direction-dependent weakening of their flexural rigidity, the sheet supporting elements keep the flexural rigidity or stability required in the direction of the printing material sheet format width. Finally, it is also conceivable to use the sheet supporting elements provided with the serpentine profile (beads) or the profile similar to a tooth system (grooving) to replace the shell segments. In this case, the vario drum would contain only the at least partially deformable sheet supporting elements and no longer the completely rigid shell segments, and the sheet supporting elements would be attached to the rotary joints provided for the shell segments in the exemplary embodiments shown and immediately adjacent to the gripper systems.

We claim:

1. A method of varying a drum profile of a vario drum for transporting printing material sheets, which comprises the steps of:

pivoting alternatively inward and outward shell segments of the vario drum;

maintaining a circular arc-shaped circumferential contour of the shell segments during the pivoting of the shell segments; and reversibly deforming sheet supporting elements assigned to the shell segments by pivoting the shell segments.

2. The method according to claim 1, which further comprises setting the drum profile to be less round by pivoting the shell segments inward and setting the drum profile to be more round by pivoting the shell segments outward.

3. A vario drum for transporting printing material sheets, comprising:

shell segments defining a drum profile and mounted for alternatively being pivoted inward and outward for varying said drum profile, said shell segments having a permanently rigid shape; and sheet supporting elements assigned to said shell segments and constructed and disposed such that said sheet supporting elements are reversibly deformable by pivoting said shell segments.

4. The vario drum according to claim 3, wherein said sheet supporting elements are flexurally elastic and similar to leaf springs.

5. The vario drum according to claim 3, wherein said sheet supporting elements are concave at a specific point when said shell segments are pivoted inward, and are convex at the specific point when said shell segments are pivoted outward.

6. The vario drum according to claim 3, wherein said sheet supporting elements are flexible and similar to cylinder covers.

7. The vario drum according to claim 3, further comprising springs tensioning said sheet supporting elements.

8. The vario drum according to claim 3, wherein said sheet supporting elements are disposed to cover said shell segments on an outside.

9. The vario drum according to claim 3, wherein said sheet supporting elements have self-supporting deformation Sections by which said drum profile is determined.

10. A machine for processing printing material sheets, comprising:

a vario drum for transporting printing material sheets, said vario drum containing:

shell segments for defining a drum profile and mounted for alternatively being pivoted inward and outward for varying said drum profile, said shell segments having a permanently rigid shape; and sheet supporting elements assigned to said shell segments and constructed and disposed such that said sheet supporting elements are reversibly deformable by pivoting said shell segments.

11. The machine according to claim 10, wherein the machine is a sheet-fed press.

* * * * *